US006899535B2

(12) United States Patent
Mihelcic et al.

(10) Patent No.: US 6,899,535 B2
(45) Date of Patent: May 31, 2005

(54) APPARATUS FOR FORMING CONCRETE FOUNDATIONS

(76) Inventors: Pete Mihelcic, 19840 Hwy. 101 North, Willits, CA (US) 95490; Daniel M. Mihelcic, 19840 Hwy. 101 North, Willits, CA (US) 95490

( * ) Notice: Subject to any disclaimer, the term of this patent is extended or adjusted under 35 U.S.C. 154(b) by 173 days.

(21) Appl. No.: 10/452,097

(22) Filed: May 30, 2003

(65) Prior Publication Data

US 2004/0241263 A1 Dec. 2, 2004

(51) Int. Cl.[7] ..... B28B 28/00

(52) U.S. Cl. ..... 425/123; 249/51; 249/93; 425/117; 425/425; 425/432

(58) Field of Search ..... 249/48, 51, 83, 249/91, 93; 425/117, 123, 425, 432

(56) References Cited

U.S. PATENT DOCUMENTS

| | | | | | |
|---|---|---|---|---|---|
| 723,064 | A | * | 3/1903 | Stoner | |
| 986,957 | A | * | 3/1911 | Wallin | |
| 1,022,231 | A | * | 4/1912 | Garey | |
| 2,448,883 | A | * | 9/1948 | Hall | |
| 3,492,395 | A | * | 1/1970 | Breitfuss | |
| 3,570,801 | A | * | 3/1971 | Moritz et al. | 249/166 |
| 3,601,870 | A | * | 8/1971 | Jones | 425/135 |
| 3,774,875 | A | | 11/1973 | Ecker | 249/178 |
| 3,851,485 | A | | 12/1974 | Steding | 249/10 |
| 3,858,866 | A | * | 1/1975 | Armstrong et al. | 269/46 |
| 3,960,356 | A | | 6/1976 | Adams | 249/93 |
| 4,673,157 | A | * | 6/1987 | Wells | 249/13 |
| 4,790,509 | A | * | 12/1988 | Cardwell et al. | 249/93 |
| 5,240,224 | A | | 8/1993 | Adams | 249/93 |
| 5,542,837 | A | | 8/1996 | Johnston | |
| 5,746,036 | A | * | 5/1998 | Angelette | 52/295 |
| 5,800,727 | A | * | 9/1998 | Croghan | 249/51 |
| 5,976,670 | A | | 11/1999 | Fugazzi | |
| 2002/0152709 | A1 | | 10/2002 | Gresser et al. | |

* cited by examiner

*Primary Examiner*—Robert B. Davis
(74) *Attorney, Agent, or Firm*—DLA Piper Rudnick Gray Cary US LLP

(57) ABSTRACT

The present invention provides an apparatus for forming concrete structures, such as railroad crossing signal foundations. The apparatus includes a generally hollow form, which is made from a strong and durable material, such as metal (e.g., steel) or composite material. The form is tapered and includes two halves that are selectively attached together for easy removal from a completed foundation. The form further includes several cantilever bolt holders that extend over the form and include holes that receive cantilever bolts that are incorporated into the foundation. One or more vibrating elements may be removably attached to the tops of the cantilever bolts and/or to the sides of the form. The air vibrators may be selectively activated during the cement pouring process to vibrate the concrete and substantially reduce or eliminate air bubbles and defects within the foundation. A pair of adjustable legs is attached to the form and allows the form to be positioned and supported over a foundation hole. Screw jacks are located at the ends of each leg, thereby allowing the form to be easily leveled relative to a ground surface.

20 Claims, 8 Drawing Sheets

APPARATUS FOR FORMING CONCRETE FOUNDATIONS

FIELD OF THE INVENTION

This invention generally relates to the formation of concrete structures and more particularly, to an improved, adjustable and reusable apparatus for forming concrete foundations, such as railroad crossing signal foundations.

BACKGROUND OF THE INVENTION

Fixtures are generally used in the formation of concrete structures, such as foundations, in order to cause the structure to assume and maintain a desired shape and form. For example, when forming a railroad crossing signal foundation, workmen typically construct a fixture having a predetermined shape and size in order to ensure that the foundation conforms to federal guidelines and regulations. This type of fixture is usually constructed by nailing together several pieces of wood in a generally rectangular or square shape. One or more wooden planks (e.g., two-by-fours) are nailed to the top of the fixture in order to hold cantilever bolts that are integrated into the foundation and used to attach the railroad crossing signal to the foundation. The fixture is placed over a hole that is dug into the ground, and the concrete is poured into the hole through the fixture. As concrete fills the fixture, the sides of the fixture are usually hit repeatedly with a hammer or other device in order to vibrate the concrete and remove air bubbles and other potential defects from the foundation. After the concrete solidifies, the fixture is pulled apart and separated. Each time the fixture has to be used, the pieces of wood must be nailed together again. As a result of this process, a typical wooden fixture receives a great deal of wear and tear, and will only provide a few uses before it must be replaced. Furthermore, the process of reconstructing the fixture after each use is undesirably time consuming. Moreover, the concrete vibrating methods used with this type of fixture (e.g., pounding the fixture with a hammer) are often ineffective and leave air bubbles and defects within the foundation.

It is therefore desirable to provide a new and improved fixture for forming railroad crossing signal foundations, which is easy to use, remove from a foundation, and reuse, and which forms an improved railroad crossing signal foundation with substantially fewer air bubbles and defects.

SUMMARY OF THE INVENTION

The present invention relates to an apparatus for forming concrete structures. In the preferred embodiment, the apparatus is adapted to form foundations for railroad crossing signals. The apparatus includes a hollow form or fixture, which is made from a strong and durable material, such as metal or composite material. The fixture is tapered and includes two halves that are selectively attached together for easy removal from a completed foundation. The fixture further includes a plurality of cantilever bolt holders that extend over the form and include holes that receive cantilever bolts that are incorporated into the foundation. The apparatus includes air vibrators that may be attached to the tops of the cantilever bolts and/or to the sides of the form. The air vibrators may be selectively activated during the concrete pouring process to vibrate the concrete and substantially reduce or eliminate air bubbles and defects within the foundation. The fixture may be attached to a pair of adjustable legs, which allow the fixture to be positioned over a foundation hole and supported over a ground surface.

Screw jacks are located at the ends of each leg, thereby allowing the fixture to be easily leveled.

One non-limiting advantage of the present invention is that it provides an improved apparatus for forming concrete foundations, such as railroad crossing signal foundations.

Another non-limiting advantage of the present invention is that it provides an improved apparatus for forming railroad crossing signal foundations, which can be easily removed from a completed foundation, and reused without substantial wear or degradation.

Another non-limiting advantage of the present invention is that it provides an apparatus for forming railroad crossing signal foundations that may be easily moved, positioned over a foundation hole, and leveled relative to a ground surface.

Another non-limiting advantage of the present invention is that it provides an apparatus for forming railroad crossing signal foundations that includes one or more vibrating units that allow the concrete, which forms the foundation, to be poured drier and hotter, and that substantially eliminates and/or reduces air bubbles from the foundation.

According to one aspect of the present invention, an apparatus for forming a concrete foundation is provided. The apparatus includes a generally hollow fixture that is adapted to receive concrete and that is shaped to form at least a portion of the foundation, the fixture including two tapered portions that are removably attached together by use of at least one fastener, effective to allow the fixture to be easily removed from a completed foundation; at least one vibrating element for selectively vibrating the concrete to reduce air bubbles and defects within the foundation; and a plurality of legs that are attached to and extend from the fixture, the legs including at least one adjustable leveling mechanism that engages a ground surface, the legs and at least one adjusting mechanism cooperating to allow the form to be supported over a foundation hole and leveled relative to the ground surface.

According to another aspect of the present invention, an apparatus is provided for forming a railroad-crossing signal foundation including a plurality of cantilever bolts that are integrated into the foundation and extend from a top surface of the foundation. The apparatus includes a generally hollow fixture that is adapted to receive concrete for forming an upper portion of the foundation, the fixture including two tapered portions that are removably attached together by use of at least one fastener, effective to allow the fixture to be easily removed from a completed foundation. At least one bolt holding member is attached to and extends over the fixture, and is adapted to receive and secure the plurality of cantilever bolts. The apparatus further includes at least one vibrating element for vibrating the concrete to reduce air bubbles and defects within the foundation; and a pair of legs that are removably attached to and extend from the fixture, each of the legs including two leveling mechanisms that are attached to opposing ends of the leg and that engage a ground surface, the legs and leveling mechanisms cooperating to allow the form to be supported over a foundation hole and leveled relative to the ground surface.

These and other aspects, features and advantages of the present invention, as well as the invention itself, will be best understood from the following drawings and detailed description.

DETAILED DESCRIPTION OF THE EMBODIMENTS

The present invention will now be described in detail with reference to the drawings, which are provided as illustrative examples of the invention so as to enable those skilled in the art to practice the invention. Preferred embodiments of the present invention are illustrated in the Figures, like numerals being used to refer to like and corresponding parts of various drawings. Where certain elements of the present invention can be partially or fully implemented using known components, only those portions of such known components that are necessary for an understanding of the present invention will be described, and detailed descriptions of other portions of such known components will be omitted so as not to obscure the invention.

Figure 1:
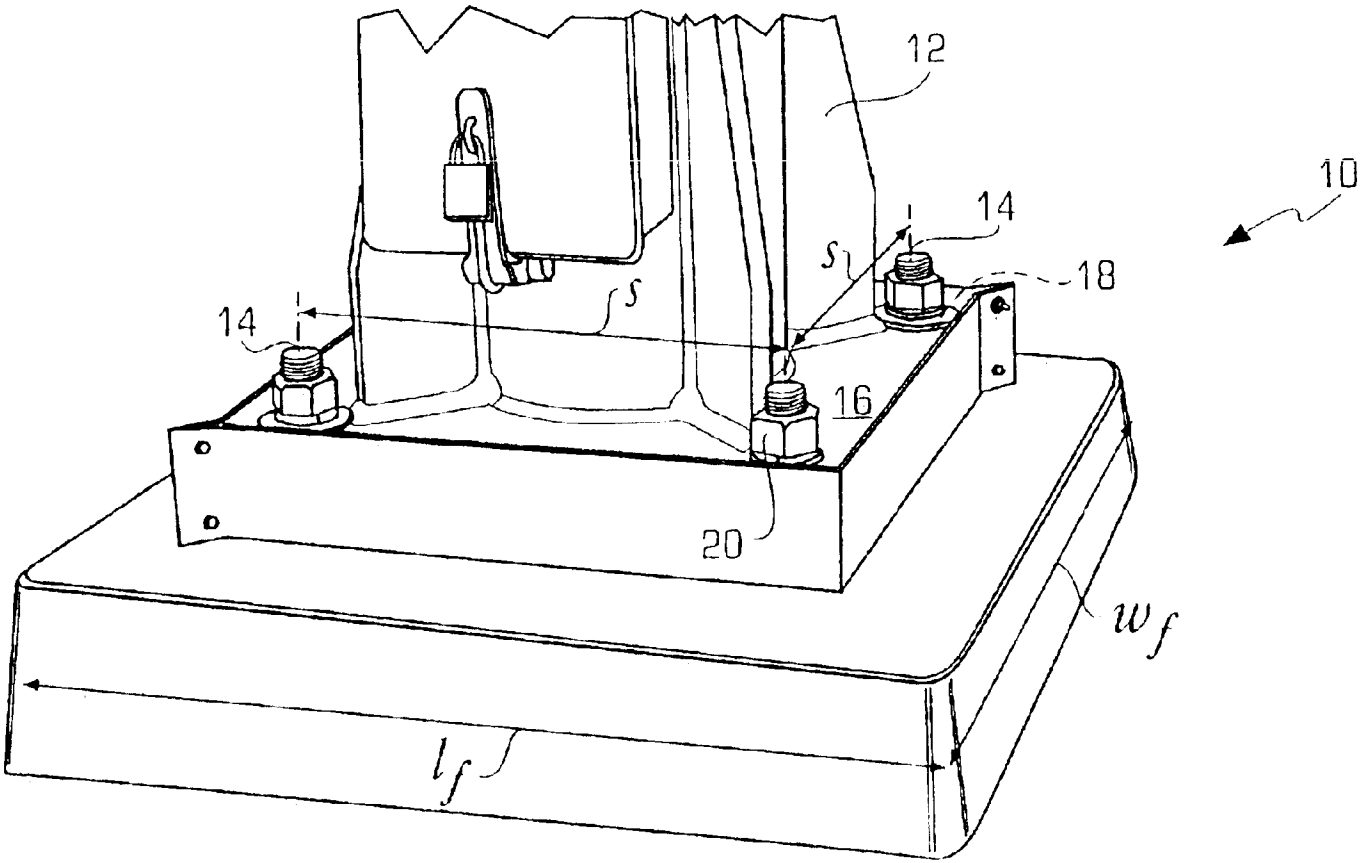
FIG. 1 illustrates a railroad crossing signal foundation that may be formed by use of the present invention.

The present invention provides an apparatus for forming concrete foundations, such as railroad crossing signal foundations. FIG. 1 illustrates one example of a railroad crossing signal foundation 10 that may be formed by use of the present invention. Foundation 10 is adapted to receive and support the weight of a railroad-crossing signal 12, which is bolted to the foundation 10. The signal 12 is attached to the foundation 10 by several bolts 14 that are integrated (e.g., cemented) into the foundation 10 and extend upward from a top surface of the foundation 10. The base 16 of the signal 12 includes several holes 18 that may be aligned with and receive bolts 14. Conventional fasteners or nuts 20 are attached to the bolts 14 in order to secure the signal 12 to the foundation 10. The embodiment shown in FIG. 1 includes four bolts 14 that are disposed in a generally square arrangement (e.g., each bolt 14 is placed at a corner of a square). Other types of railroad crossing signal foundations may include eight bolts that are disposed in a generally rectangular arrangement. The shape and size of railroad crossing signal foundations, such as foundation 10, are governed by federal standards. Foundation 10 should have a length ($l_f$) and width ($w_f$) that fall within a certain range, and should extend a certain depth below ground. For the type of foundation shown in FIG. 1, the length ($l_f$) and width ($w_f$) are about the same (e.g., approximately 32"–34"). The spacing (s) of bolts 14 must be relatively precise (e.g., 19" from center) so that they can be aligned with and receive the holes 18 that are formed within the base 16 of signal 12.

Figure 2:
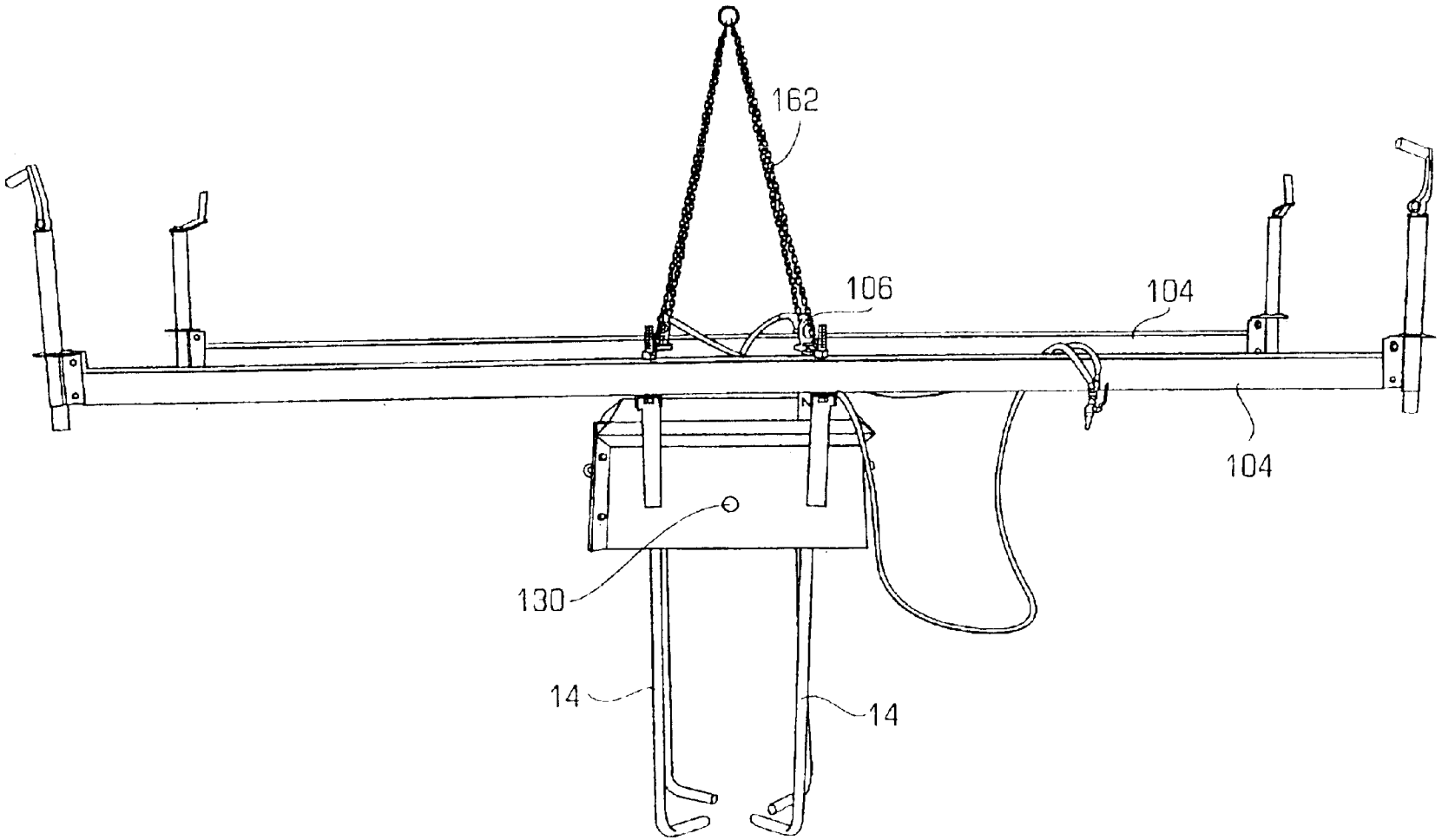
FIG. 2 is a side view of a first embodiment of an apparatus for forming railroad crossing signal foundations, according to the present invention.
Figure 3:
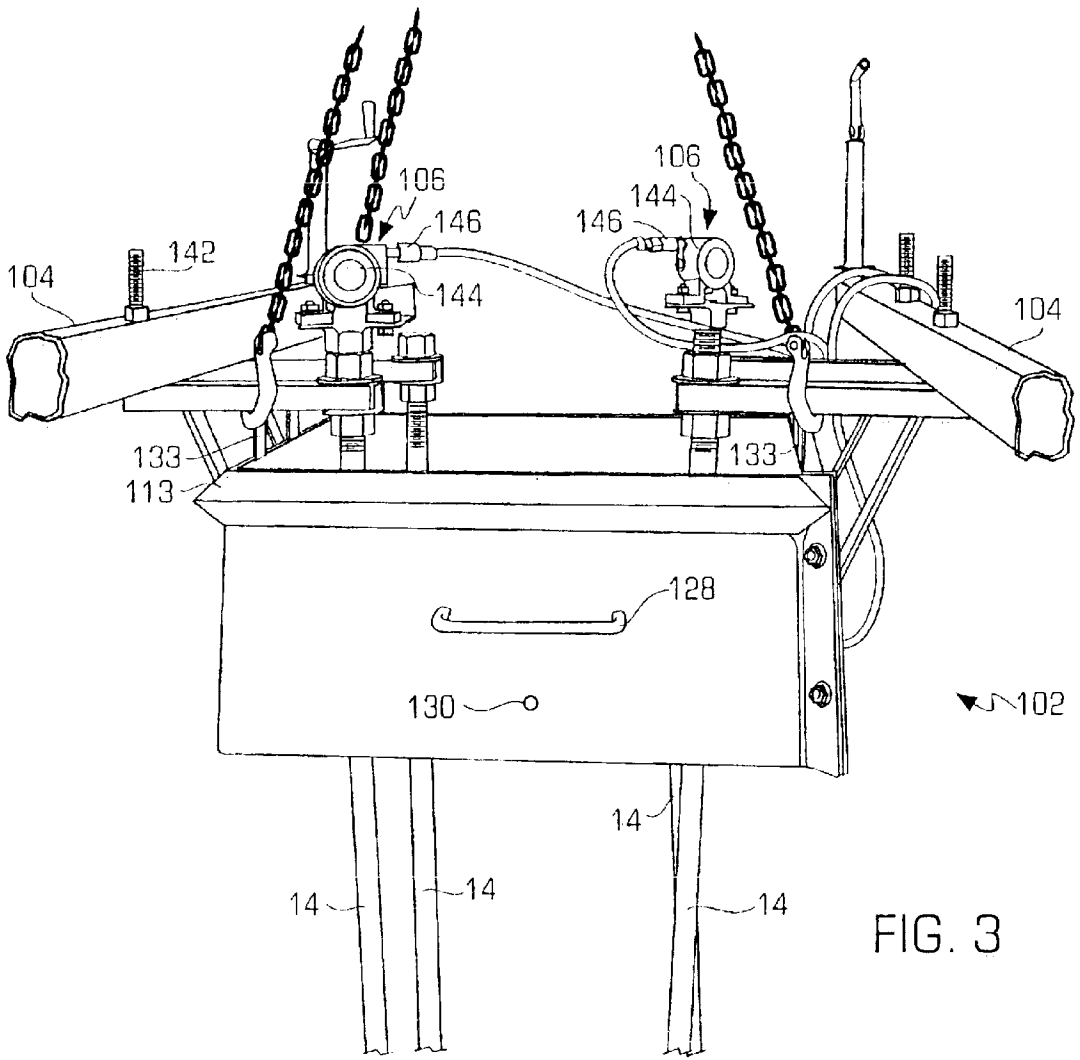
FIG. 3 is a front view of the apparatus shown in FIG. 2.

FIGS. 2–3 illustrate a first embodiment of an apparatus 100 for forming railroad crossing signal foundations 10, according to the present invention. While the following discussion concerns the formation of railroad crossing signal foundations 10, the present invention is not limited to this application, but may be used to form concrete foundations and structures for any type of application. Apparatus 100 includes a generally hollow form or fixture 102, a pair of legs 104, which are connected to the fixture 102 and which allow the fixture to be positioned and supported over a foundation hole, and a several vibrating elements 106.

Figure 4:
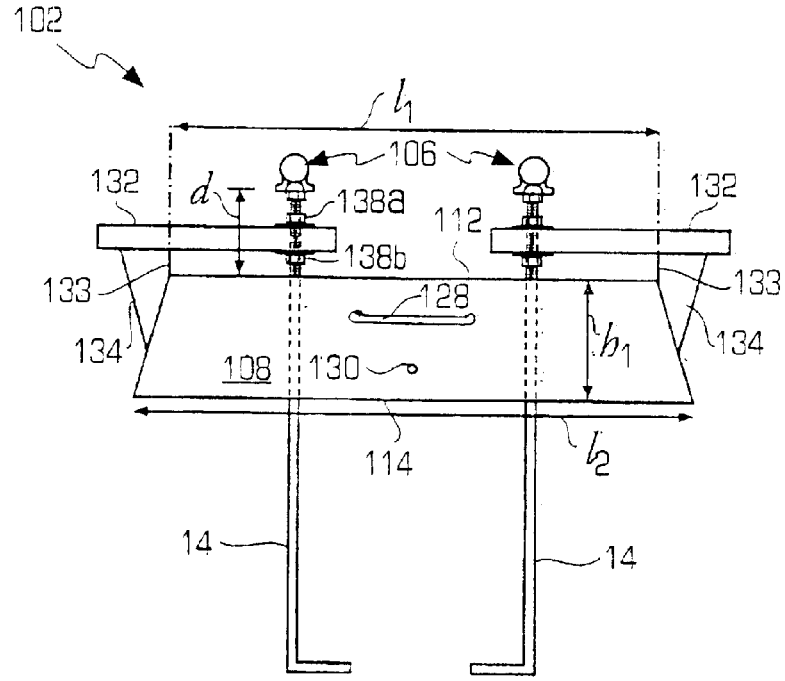
FIG. 4 is a side view of the fixture portion of the apparatus shown in FIG. 2, including attached cantilever bolts.
Figure 5:
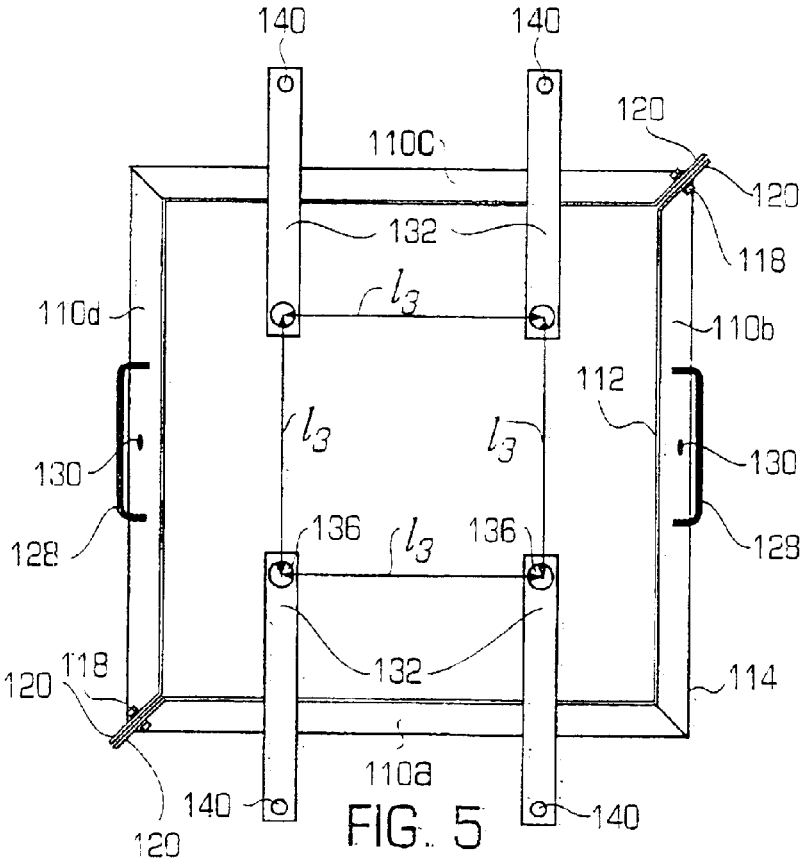
FIG. 5 is a top view of the fixture portion of the apparatus shown in FIG. 2.
Figure 6:
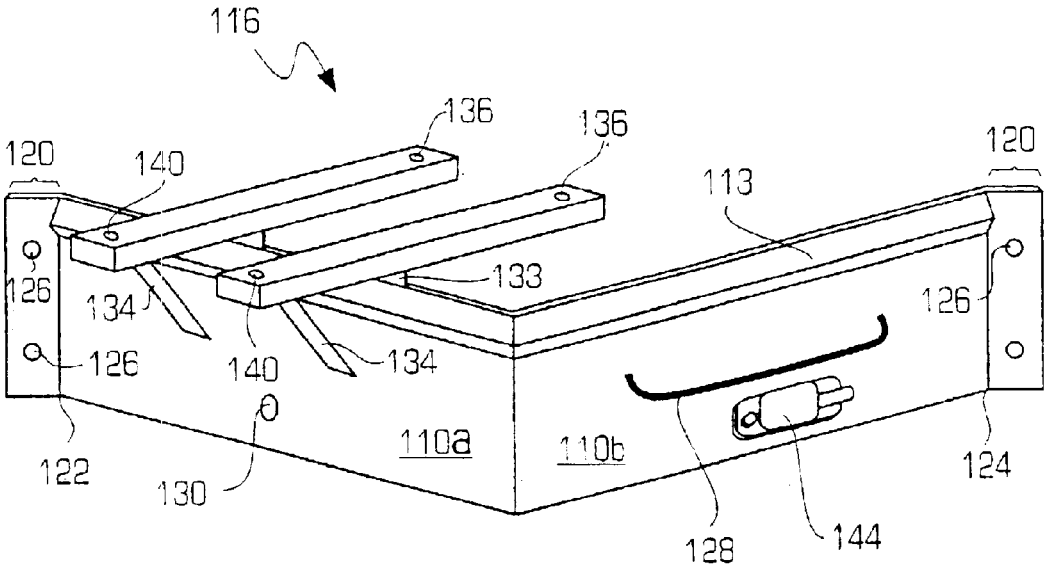
FIG. 6 is a perspective view of one-half of the fixture portion of the apparatus shown in FIG. 2.

FIGS. 4, 5 and 6 illustrate a preferred embodiment of a fixture 102. Fixture 102 is preferably made from a strong and durable material, such as metal (e.g., steel) or composite material, which allows the formed to be reused many times without substantial degradation. The fixture 102 includes a tapered base portion 108 that is formed by four substantially identical plates 110*a–d*. Each plate 110*a–d* is tapered and includes a generally flat top edge 112 having a predetermined length (l1), which in one embodiment may be approximately 32 inches. Each plate 110 further includes a generally flat bottom edge 114 having a predetermined length (l2), which in one embodiment may be approximately 34 inches. As such, the fixture 102 is tapered, and has a generally rectangular (e.g., square), lateral cross-section, as shown best in FIG. 5. In one embodiment, the height (h1) of each plate 110*a–d* is approximately 15 inches. A lateral brace 113 may extend along each top edge 114 to provide support and rigidity to base portion 108.

The base portion 108 is formed by two substantially identical portions or halves 116 that are removably attached together by use of conventional fasteners 118. As shown best in FIG. 6, each half 116 is formed by two plates (e.g., plates 110*a,b* and plates 110*c,d*), which are fixedly attached together (e.g., welded). Each half 116 includes a pair of flanges 120, which orthogonally project from opposing corners 122, 124. Each flange 120 mates with a corresponding flange from the other half 116 of the base portion 108 and includes a pair of holes 126 that receive fasteners 118, thereby allowing the halves 116 to be removably attached together to form base portion 108. The inner surface of the entire base portion 108 may be coated with a non-stick material, such as Powercoat™ or a similar synthetic coating.

Two handles 128 are attached to opposing plates 110*b* and 110*d*, and allow the fixture 102 to be moved by hand. In one embodiment, plates 110*b* and 110*d* also include a pair of bolts 130 that are fixedly attached (e.g., welded) to and project from the center region of the plates. Each bolt 130 is adapted to receive a vibrating unit 106, which may be removably attached to (e.g., screwed onto) the bolt 130. Each half 116 further includes a pair of cantilever bolt holders or members 132. In one embodiment, members 132 may be formed from conventional box tubing. Members 132 may be attached (e.g., welded) to plates 110*a* and 110*c*. In one embodiment, members 132 may be connected to the top edges 112 of plates 110*a,c* by support arms 133. Additional support arms 134 may be welded to members 132 and to the sides of plates 110*a* and 110*c* to further secure the members 132 to the base portion 108 of the fixture 102. Each member 132 includes a hole or slot 136 near its innermost end for receiving a cantilever bolt 14. Cantilever bolts 14 may be attached to fixture 102 by inserting the bolts 14 through inner slots 136 and securing the bolts to members 132 by use of conventional fasteners 138*a* and 138*b*, which may comprise conventional nuts and washers, as shown in FIGS. 4 and 8. In the preferred embodiment, the slots 136 are arranged in a generally square configuration with a spacing (l3) of approximately 19 inches between the centers of adjacent slots. This configuration ensures the when the cantilever bolts 14 are integrated into a foundation 10, which is formed by apparatus 100, the bolts 14 are disposed at the desired spacing to receive a standard railroad crossing signal 12. Each of members 132 further includes a hole 140 near its outer end, which allows the fixture 102 to be removably attached to legs 104 by use of conventional fasteners 142 (e.g., bolt type fasteners), as shown in FIG. 3.

Figure 7:
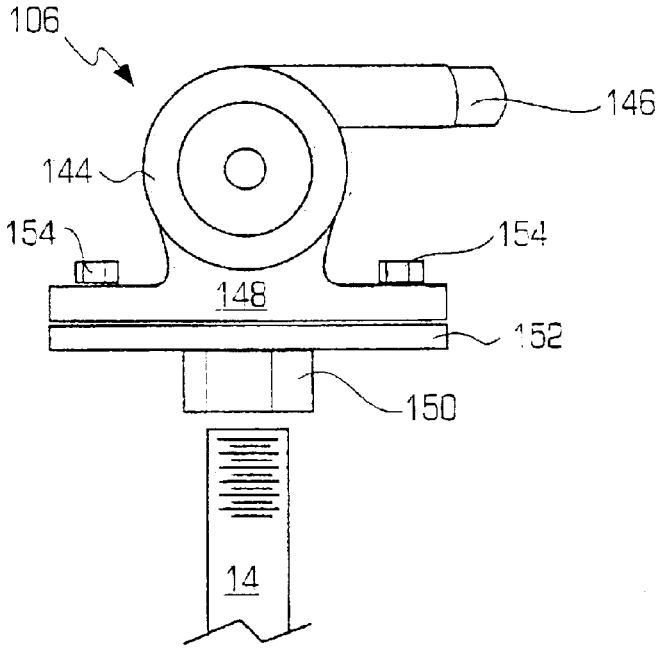
FIG. 7 is a side view of an air vibrator, which may be attached to a cantilever bolt.
Figure 8:
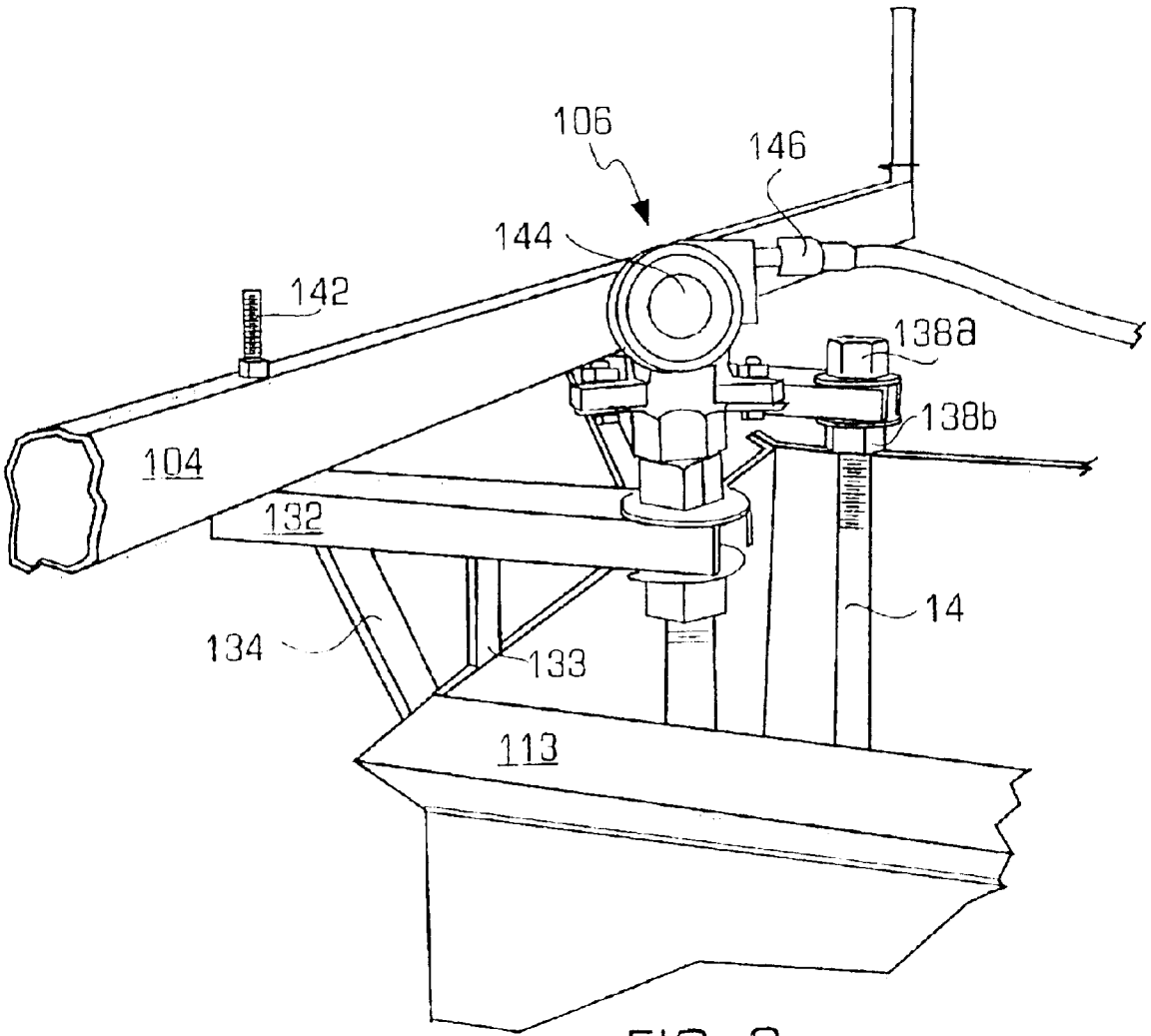
FIG. 8 is a partial, perspective view of the apparatus of FIG. 2, illustrating the attachment of the cantilever bolts, air vibrators and legs to the fixture portion of the apparatus.

As shown best in FIGS. 7 and 8, vibrating units 106 comprise conventional air vibrators 144, which are adapted to be removably attached to bolts 14 and/or 130. Each air vibrator 144 includes an intake port 146, which are adapted to be secured to a conduit for connecting the vibrators to a conventional source of pressurized air (not shown). The base 148 of each air vibrator may be attached to a threaded member 150 (e.g., nut). In one embodiment, threaded member 150 is attached (e.g., welded) to a plate 152, which is in turn attached to base 148 by use of conventional fasteners 154. As discussed below, the air vibrators 144 may be selectively activated during the cement pouring process to vibrate the concrete and substantially reduce or eliminate air bubbles and defects within the foundation. In one embodiment, four air vibrators 144 may be used. Particularly, two vibrating units 106 may be attached to opposing cantilever bolts 14, as shown in FIGS. 3 and 8, and two vibrating units 106 may be attached to plates 110*b* and 110*d*. In other embodiments, more or fewer vibrators 144 may be used.

Figure 9:
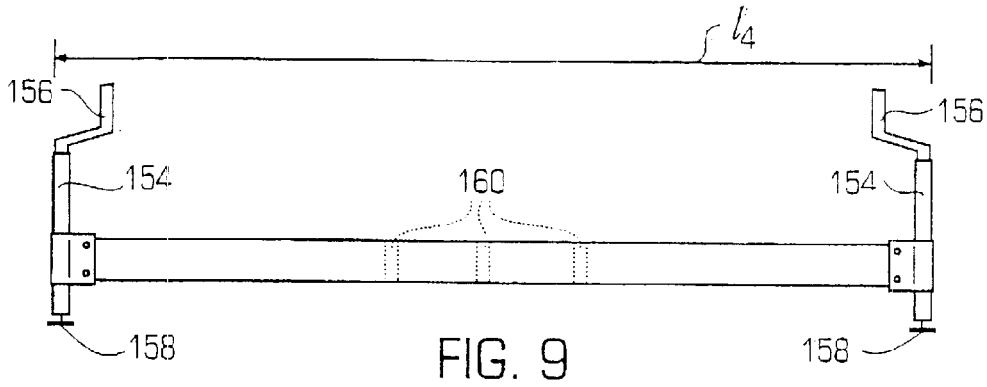
FIG. 9 is side view of a leg of the apparatus shown in FIG. 2.

FIG. 9 illustrates one of the substantially identical legs 104 of apparatus 100. Each leg 104 is a generally elongated member formed from a relatively strong and rigid material (e.g., metal). In one embodiment, legs 104 may have a length (l4) of approximately 12 feet, 6 inches. Each leg 104 includes two conventional screw jacks 154 that are located at the opposing ends of each leg 104, as shown in FIG. 9. Each screw jack or leveling mechanism 154 may include a handle 156 that may be rotated in clockwise and counter-clockwise directions to selectively lower and raise foot portions 158. Foot portions 158 are adapted to engage a ground surface over which the apparatus 100 may be disposed. By adjusting the various screw jacks 154, the fixture 102 may be easily leveled relative to the ground surface. Screw jacks 154 may be attached to legs 104 in a conventional manner (e.g., by use of bolt fasteners). In other embodiments, screw jacks 154 can be replaced with other types of height-adjusting or leveling mechanisms (e.g., conventional jacks, hydraulic jacks, shocks, leveling coils and the like). Additionally, screw jacks 154 may be replaced with non-adjustable or rigid foot portions. In alternate embodiments, the fixture 104 may be attached to different numbers of individual leg members.

The legs 104 also include several fixture attachment holes 160, which are spaced apart at a length of l3 (e.g., 19 inches), thereby allowing the legs 104 to be attached to members 136 by use of fasteners 142. In the preferred embodiment, each leg 104 includes at least three holes 160. The use of multiple sets of holes 160 allow the legs 104 to be laterally offset relative to each other and fixture 102, thereby allowing the legs 104 to adjust for obstacles or surface irregularities (e.g., curbs, walls, stumps and the like) near the site of the foundation hole.

In operation, apparatus 100 may be used to form concrete foundations, such as railroad crossing signal foundations 10. In order to use apparatus 100, the apparatus 100 is suspended in the air, as shown in FIG. 2. This may be accomplished by connecting chains 162 to the members 132 and lifting the chains with an industrial vehicle, such as a backhoe. Cantilever bolts 14 are then inserted through the bottom of the fixture 102, such that the top of the each of the bolts 14 pass through one of holes 136. Fasteners 138*b* are attached to the bolts 14 prior to inserting the bolts 14 through holes 136. Fasteners 138*b* are placed at a predetermined position so that the bolts 14 will extend a certain distance (d) above the fixture 102 (see FIG. 4) when the bolts 14 are fastened to the members 132. The distance (d) will represent the distance that the bolts 14 will extend from the top surface of the foundation 10, and may be determined by federal regulation. Each bolt 14 is inserted into a hole 136 until the fastener 138*b* engages the bottom surface of the member 132. Then the top fastener 138*a* is screwed onto the bolt 14 until it engages the top surface of member 132. The fasteners 138*a* and 138*b* may then be tightened, effective to secure the bolts 14 to the members 132.

Once the bolts 14 are secured to the fixture 102, the vibrating units 106 may be attached to the tops of bolts 14 and/or to the sides of the fixture 102 (e.g., to bolts 130). In the preferred embodiment, two vibrating units 106 are attached to the top of two bolts 14, as show in FIG. 8, and two vibrating units 106 are attached to the sides of fixture 102, i.e., to bolts 130, as shown in FIG. 6. The apparatus 100 is then moved over a foundation hole. The apparatus 100 is lowered so that the bottom of the fixture 102 is relatively level to the ground surface, the bottom portion of bolts 14 extend into the foundation hole, and the top of the fixture 102 extends above the ground surface. Legs 104 hold the fixture 102 in place. Particularly, the foot portions 158 of screw jacks 152 engage the ground surface and support fixture 102. The screw jacks 152 may be adjusted to level the fixture 102 relative to the ground surface by rotating the handles 156.

Once the fixture 102 is leveled, concrete is poured into the top of the fixture 102 and begins to fill the foundation hole. The vibrating units 106 that are coupled to the tops of bolts 14 are intermittently activated during this pouring phase. In one embodiment, the vibrating units 106 are activating for 30-second intervals for every two feet of concrete poured. By activating these vibrating units 106, the concrete at the bottom of the foundation 10 is vibrated by the bottom portion of bolts 14, thereby removing air bubbles and allowing the concrete to settle relatively quickly. This allows the concrete to be poured drier and hotter, thereby significantly reducing the time required to form a foundation 10 relative to prior methods. Concrete continues to be poured into the fixture 102 and fills the foundation hole. The concrete then begins to fill the fixture 102. As concrete fills the fixture 102, the vibrating units 106 that are attached to the sides of the fixture 102 are selectively and intermittently activated. Activating these vibrating units 106 removes air bubbles from the foundation 10 and ensures that the sides of the foundation 10 do not stick to the fixture 102. This achieves a foundation 10 with substantially no defects and a smooth outer surface. If only a pair of vibrating elements 106 is available, the vibrating elements 106 can be moved from the cantilever bolts 14 to the sides of the fixture 102 during the pouring process.

Once the foundation 10 is substantially dry, the fixture 102 may be removed. In order to remove the fixture 102, jacks 158 are first raised to remove pressure. The legs 104 are then removed from the fixture 102 by removing fasteners 142. The vibrating units 106 are then removed from cantilever bolts 14. Fasteners 138*a* are then removed from cantilever bolts 14. The fixture 102 is then partially separated by loosening side fasteners 118. The tapered shape of fixture 102 allows the fixture 102 to be easily removed from the foundation 10 by lifting the loosened fixture 102 over the completed foundation 10. Additionally, a non-stick coating or lubricant can be applied to the inner surface of the fixture 102 to further prevent the fixture 102 from sticking to the sides of the foundation 10.

Figure 10:
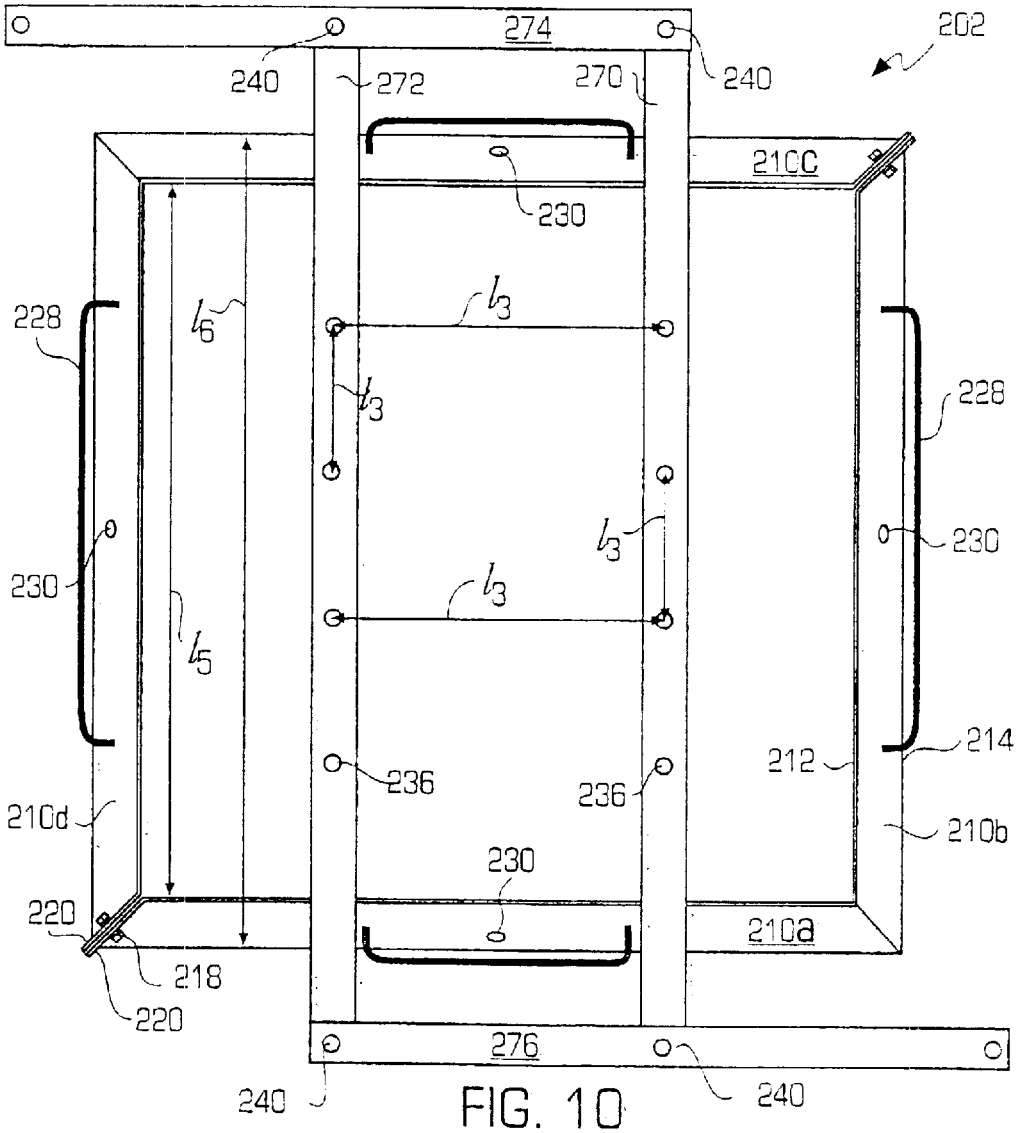
FIG. 10 is a top view of second embodiment of a fixture for an apparatus for forming railroad crossing signal foundations.
Figure 11:
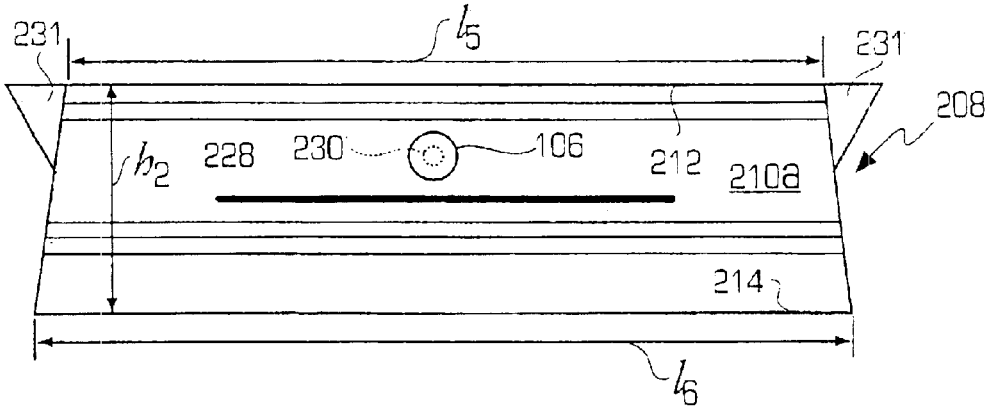
FIG. 11 is a side view of the fixture shown in FIG. 10.
Figure 12:
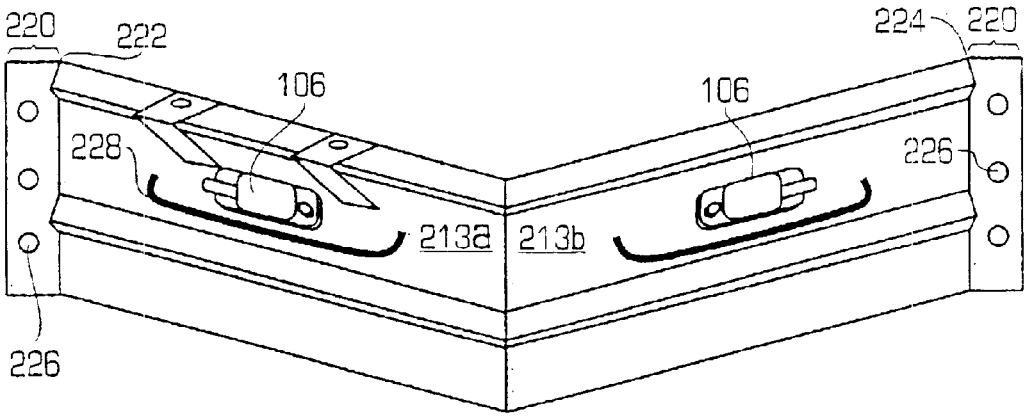
FIG. 12 is a perspective view of one-half of the fixture shown in FIG. 10.

FIGS. 10, 11 and 12 illustrate a second embodiment of a fixture 202 that can be used within an apparatus for forming railroad crossing signal foundations, according to the present invention. Particularly, fixture 202 can be attached to legs 106 and used in a substantially identical manner to apparatus 100 in order to form railroad crossing signal foundations. Fixture 202 is adapted to form a larger type of foundation, which may be required to support larger crossing signals that are attached by eight cantilever bolts.

Fixture 202 is preferably made from a strong and durable material, such as metal (e.g., steel) or composite material, which allows the fixture 202 to be reused many times without substantial degradation. The fixture 202 includes a tapered base portion 208 that is formed by four substantially identical plates 210*a–d*. Each plate 210*a–d* is tapered and includes a generally flat top edge 212 having a predetermined length (l5), which in one embodiment may be approximately 65 inches. Each plate 210*a–d* further includes a generally flat bottom edge 214 having a predetermined length (l6), which in one embodiment may be approximately 67 inches. As such, the fixture 202 is tapered, and has a generally rectangular (e.g., square) lateral cross-section, as shown in FIG. 10. In one embodiment, the height (h2) of each plate 210*a–d* may be approximately 15 inches. A first lateral brace 213*a* may extend along each top edge 214, and a second lateral brace 213*b* may extend laterally across the center region of each plate to provide support and rigidity to base portion 208.

The base portion 208 is formed by two substantially identical portions or halves 216 that are removably attached together by use of conventional fasteners 218. As shown best in FIG. 12, each half 216 is formed by two plates (e.g., plates 210*a,b* and plates 210*c,d*), which are fixedly attached together (e.g., welded). Each half 216 includes a pair of flanges 220, which orthogonally project from opposing corners 222, 224. Each flange 220 includes several holes 226, which receive fasteners 218, thereby allowing the halves 216 to be removably attached together to form base portion 208.

A handle 228 may be attached to each plate 210*a–d*, for allowing the fixture 202 to be moved by hand. In one embodiment, each plate 210*a–d* also includes a bolt 230 that is fixedly attached (e.g., welded) to and project from the center region of the plate. Each bolt 230 is adapted to receive a vibrating element 106, which may be removably attached to (e.g., screwed onto) the bolt 230. Each half 216 further includes a pair of tabs 231 for attaching to a cantilever bolt holder assembly 232. Tabs 231 may be welded to or integrally formed with plates 210*a* and 210*c*. Bolt holder assembly 232 may be secured to tabs 231 of plates 210*a* and 210*c* by use of conventional fasteners (not shown). As shown best in FIG. 10, assembly 232 is formed from two cross members 270, 272 which are connected together by end members 274, 276 which may be attached to members 270, 272 in a conventional manner (e.g., by use of conventional fasteners). Each member 270, 272 includes four holes 236 for receiving cantilever bolts 14. Cantilever bolts 14 may be attached to form 202 by inserting the bolts 14 through holes 236 and securing the bolts 14 to members 270, 272 by use of conventional fasteners (not shown), which may comprise conventional nuts and washers (e.g., fasteners substantially identical to fasteners 138*a*, 138*b*). In the preferred embodiment, the holes 236 are arranged in a generally rectangular configuration with a spacing (l3) of approximately 19 inches between the centers of adjacent holes. This configuration ensures the when the cantilever bolts 14 are integrated into a foundation, the bolts 14 are disposed at the desired spacing to receive a large-size railroad crossing signal. Each of members 270, 272 further includes holes 240 near its outer ends, which allows the fixture 202 to be removably attached to legs 104 by use of conventional fasteners (e.g., bolt type fasteners).

Fixture 202 operates in a substantially identical manner to fixture 102 and is adapted to form a larger type of foundation, which may be required to support larger crossing signals that are attached by eight cantilever bolts. In this manner, fixture 202 provides the same advantages and benefits previously described in relation to apparatus 100.

While the invention has been particularly shown and described with respect to illustrative and preferred embodiments thereof, it will be understood by those skilled in the art that the foregoing and other changes in form and details may be made therein without departing from the spirit and scope of the invention that should be limited only by the scope of the appended claims.

What is claimed is:

1. An apparatus for forming a concrete foundation, comprising:

a generally hollow fixture that is adapted to receive concrete and that is shaped to form at least a portion of the foundation, the fixture including two tapered portions that are removably attached together by use of at least one fastener, effective to allow the fixture to be easily removed from a completed foundation;

at least one vibrating element for selectively vibrating the concrete to reduce air bubbles and defects within the foundation; and a plurality of legs that are attached to and extend from the fixture, the legs including at least one adjustable leveling mechanism that engages a ground surface, the legs and at least one adjustable leveling mechanism cooperating to allow the form to be supported over a foundation hole and leveled relative to the ground surface.

2. The apparatus of claim 1 wherein the at least one vibrating element comprises an air vibrator.

3. The apparatus of claim 1 wherein the at least one vibrating element is removably attached to at least one side of the fixture.

4. The apparatus of claim 1 wherein each portion of the fixture includes a pair of flanges, which orthogonally project from opposing corners of the portion, each of the flanges mating with a corresponding flange of the other portion and including at least one hole that receives a fastener, effective to removably attach the portions together to form the fixture.

5. The apparatus of claim 1 wherein the foundation includes one or more bolts that extend from the top of the fixture, the apparatus further comprising:

one or more bolt holders attached to and extending over the fixture, the one or more bolt holders including holes for receiving the bolts and allowing the bolts to be attached to the fixture.

6. The apparatus of claim 1 wherein the fixture further comprises a plurality of handles extending from sides of the fixture.

7. The apparatus of claim 1 wherein the at least one adjustable leveling mechanism comprises a plurality of jacks.

8. The apparatus of claim 7 wherein the jacks comprise screw jacks.

9. An apparatus for forming a railroad-crossing signal foundation including a plurality of cantilever bolts that are integrated into the foundation and extend from a top surface of the foundation, the apparatus comprising:

a generally hollow fixture that is adapted to receive concrete for forming an upper portion of the foundation, the fixture including two tapered portions that are removably attached together by use of at least one fastener, effective to allow the fixture to be easily removed from a completed foundation;

at least one bolt holding member that is attached to and extends over the fixture, the at least one bolt holding member being adapted to receive and secure the plurality of cantilever bolts;

at least one vibrating element for vibrating the concrete to reduce air bubbles and defects within the foundation; and a pair of legs that are removably attached to and extend from the fixture, each of the legs including two leveling mechanisms that are attached to opposing ends of the leg and that engage a ground surface, the legs and leveling mechanisms cooperating to allow the form to be supported over a foundation hole and leveled relative to the ground surface.

10. The apparatus of claim 9 wherein the at least one vibrating element is adapted to be removably attached to one or more of the cantilever bolts.

11. The apparatus of claim 9 wherein at least one side of the fixture includes a projecting portion, and wherein the at least one vibrating element is adapted to be removably attached to the projecting portion.

12. The apparatus of claim 9 wherein the at least one vibrating element comprises an air vibrator.

13. The apparatus of claim 9 wherein each of the portions of the fixture includes a pair of flanges, which orthogonally project from opposing corners of the portion, each of the flanges mating with a corresponding flange of the other portion and including at least one hole that receives a fastener, effective to removably attach the portions together to form the fixture.

14. The apparatus of claim 9 wherein the fixture includes four sides each having a top and a bottom edge.

15. The apparatus of claim 14 wherein each top edge is approximately 32 inches in length and each bottom edge is approximately 34 inches in length.

16. The apparatus of claim 14 wherein each top edge is approximately 65 inches in length and each bottom edge is approximately 67 inches in length.

17. The apparatus of claim 9 wherein the leveling mechanisms comprise screw jacks.

18. The apparatus of claim 9 wherein the at least one bolt holding member is formed from box tubing.

19. The apparatus of claim 9 wherein the fixture includes a plurality of handles that are attached to sides of the fixture.

20. The apparatus of claim 9 wherein each of the legs is adapted to be attached to the fixture in a plurality of offset positions, thereby allowing the legs to be offset relative to each other.

* * * * *